US009168416B2

(12) United States Patent
Ho et al.

(10) Patent No.: US 9,168,416 B2
(45) **Date of Patent: *Oct. 27, 2015**

(54) ABDOMEN EXERCISE MACHINE

(71) Applicants: Wei-Teh Ho, Taipei (TW); Willy Ho, Taipei (TW)

(72) Inventors: Wei-Teh Ho, Taipei (TW); Willy Ho, Taipei (TW)

( * ) Notice: Subject to any disclaimer, the term of this patent is extended or adjusted under 35 U.S.C. 154(b) by 172 days.

This patent is subject to a terminal disclaimer.

(21) Appl. No.: 13/914,522

(22) Filed: Jun. 10, 2013

(65) Prior Publication Data

US 2014/0274617 A1 Sep. 18, 2014

Related U.S. Application Data

(63) Continuation-in-part of application No. 13/797,393, filed on Mar. 12, 2013.

(51) Int. Cl.

| | |
|---|---|
| ***A63B 26/00*** | (2006.01) |
| ***A63B 23/02*** | (2006.01) |
| ***A63B 21/068*** | (2006.01) |
| *A63B 21/00* | (2006.01) |

(Continued)

(52) U.S. Cl.

CPC ..... *A63B 23/0211* (2013.01); *A63B 21/068* (2013.01); *A63B 21/1469* (2013.01); *A63B 21/1492* (2013.01); *A63B 21/1496* (2013.01); *A63B 21/159* (2013.01); *A63B 21/1457* (2013.01); *A63B 21/1461* (2013.01); *A63B 2023/003* (2013.01); *A63B 2069/0062* (2013.01); *A63B 2208/0233* (2013.01)

(58) Field of Classification Search

CPC ..... A63B 23/0205; A63B 23/0211
USPC ..... 482/140, 142, 79–80, 148, 57, 70–71, 482/96, 92–95, 131, 133, 137, 908; 297/353

See application file for complete search history.

(56) References Cited

U.S. PATENT DOCUMENTS

| | | | |
|---|---|---|---|
| 5,308,306 | A | 5/1994 | Wang |
| 5,971,897 | A | 10/1999 | Olson et al. |

(Continued)

FOREIGN PATENT DOCUMENTS

| | | |
|---|---|---|
| DE | 20010072 | 8/2000 |
| DE | 20313843 | 11/2003 |
| DE | 202006008113 | 7/2006 |

OTHER PUBLICATIONS

EPO Communication for European Application No. 13189521.1 containing the Extended European Search Report and Opinion, (dated Jul. 14, 2014, received Feb. 26, 2015), 9 pages.

*Primary Examiner* — Loan H Thanh
*Assistant Examiner* — Megan Anderson
(74) *Attorney, Agent, or Firm* — Blakely Sokoloff Taylor Zafman LLP

(57) ABSTRACT

An exercise machine applicable for strengthening a user's abdominal muscles is described. The exercise machine can include a base frame having a seat pad, a front leg and a rear leg. The seat pad can be elevated with the front leg and rear legs to provide round support. A mounting assembly may be rotatably mounted on the base frame over the rear leg. The mounting assembly can have at least one pivot joint. A backrest assembly can be movably coupled to the mounting assembly via the at least one pivot joint for swivel movements along the base frame. The backrest assembly can a backrest pad and handle bars. The handle bars can allow a user resting against the backrest pad to control the swivel movements while sitting on the seat pad.

14 Claims, 5 Drawing Sheets

(51) Int. Cl.
*A63B 69/00* (2006.01)
*A63B 23/00* (2006.01)

(56) References Cited

U.S. PATENT DOCUMENTS

| | | | | |
|---|---|---|---|---|
| 6,152,866 | A | 11/2000 | Kuo | |
| 6,287,243 | B1 | 9/2001 | Isom et al. | |
| 6,716,144 | B1 * | 4/2004 | Shifferaw | 482/140 |
| 8,062,196 | B1 * | 11/2011 | Khubani | 482/140 |
| 8,235,876 | B2 | 8/2012 | Reyes | |
| 2004/0067831 | A1 | 4/2004 | Hou | |
| 2004/0067931 | A1 * | 4/2004 | Kelly et al. | 514/210.21 |
| 2005/0101463 | A1 | 5/2005 | Chen | |
| 2007/0259762 | A1 * | 11/2007 | Ho | 482/142 |
| 2008/0051274 | A1 | 2/2008 | Greene | |
| 2009/0105054 | A1 * | 4/2009 | Boland et al. | 482/140 |
| 2009/0186749 | A1 | 7/2009 | Zhou | |
| 2012/0058867 | A1 * | 3/2012 | Mishan et al. | 482/140 |
| 2012/0065037 | A1 * | 3/2012 | Chen et al. | 482/140 |

* cited by examiner

300A

300B

ABDOMEN EXERCISE MACHINE

CROSS-REFERENCE TO RELATED APPLICATIONS

The present application is a continuation in part of, and claims the benefit of U.S. patent application Ser. No. 13/797,393, filed on Mar. 12, 2013, entitled "ABDOMEN EXERCISE MACHINE", which is hereby incorporated by reference in its entirety into this application.

FIELD OF INVENTION

The present invention relates generally to physical training machines, and in particular, exercise machines structured to support twistable body bending for exercising the abdominal muscles of a user.

BACKGROUND

With the growing awareness of health problems caused by lack of exercise, popularity of exercising machines has been continuously increasing. Typically, these machines are designed for movements of specific parts of the body. For example, abdominal machines may be structured to induce body exercises to strengthen the abdominal muscles.

Existing abdominal machines, however, are usually designed based on variations of sit-ups exercises. Effective abdominal exercises may require a combination of movements involving muscles of different parts of the body including the waist, legs, etc. Although there are many exercising machines available for exercising different parts of the body, these multipurpose exercising machines are usually heavy and expensive devices. Further, these devices are often directed for a user to perform one degree of exercise movements at a time.

Therefore, traditional abdomen machines are not structured economically and effectively to facilitate a user to exercise abdomen muscles with multi degrees of movements at a time.

SUMMARY OF THE DESCRIPTION

An exercise machine supporting twistable body bending for strengthening a user's abdominal muscles (e.g. allowing twistable pivoting movements) can include a base frame having a seat pad (or sitting bench), a front leg and a rear leg. The seat pad can be elevated with the front leg and rear legs to provide round support. A mounting assembly may be rotatably mounted on the base frame over the rear leg. The mounting assembly can have at least one pivot joint. A backrest assembly can be movably coupled to the mounting assembly via the at least one pivot joint for swivel movements along the base frame. The backrest assembly can a backrest pad (or backrest bench) and handling controls. The handling controls, such as handle bars, can allow a user resting against the backrest pad to control the swivel movements while sitting on the seat pad.

In another embodiment, an exercising machine can comprise a base frame to provide floor support and a pivoting frame rotatably mounted on the rear side of the base frame to allow swivel movements of the pivoting frame along the base frame arranged longitudinally between a front side and a rear side. The base frame can a seat pad affixed on top of the base frame. The pivoting frame can a backrest assembly, a mounting assembly and handle bars. The backrest assembly can have a backrest pad and lever bars. The backrest pad can be pivotally coupled with the level bars. The mounting assembly can have more than one rotatable or pivoting joints. The backrest pad and the lever bars may be pivotally coupled with the mounting assembly via at least one of the rotatable joints. The base frame can be engaged with the mounting assembly via one of the rotatable joints for the rotatable mounting to allow angular relationship between longitudinal directions of the seat pad and the backrest pad. Handle bars are transversely affixed to the lever bars to allow a user to make push/pull force to cause the swivel movements of the backrest pad, and wherein the angular relationship allows twisting effects on the user while exercising with the backrest pad via the swivel moments.

Other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The present invention is illustrated by way of examples and not limitations in the figures of the accompanying drawings, in which like references indicate similar elements and in which.

DETAILED DESCRIPTION

In the following description, numerous specific details are set forth, such as examples of external surfaces, named components, connections between components, etc., in order to provide a thorough understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Further specific numeric references such as first, second, third, etc., may be made. However, the specific numeric references should not be interpreted as a literal sequential order but rather interpreted as references to different objects. Thus, the specific details set forth are merely exemplary. The specific details may be varied from and still be contemplated to be within the spirit and scope of the present invention.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

Figure 1:
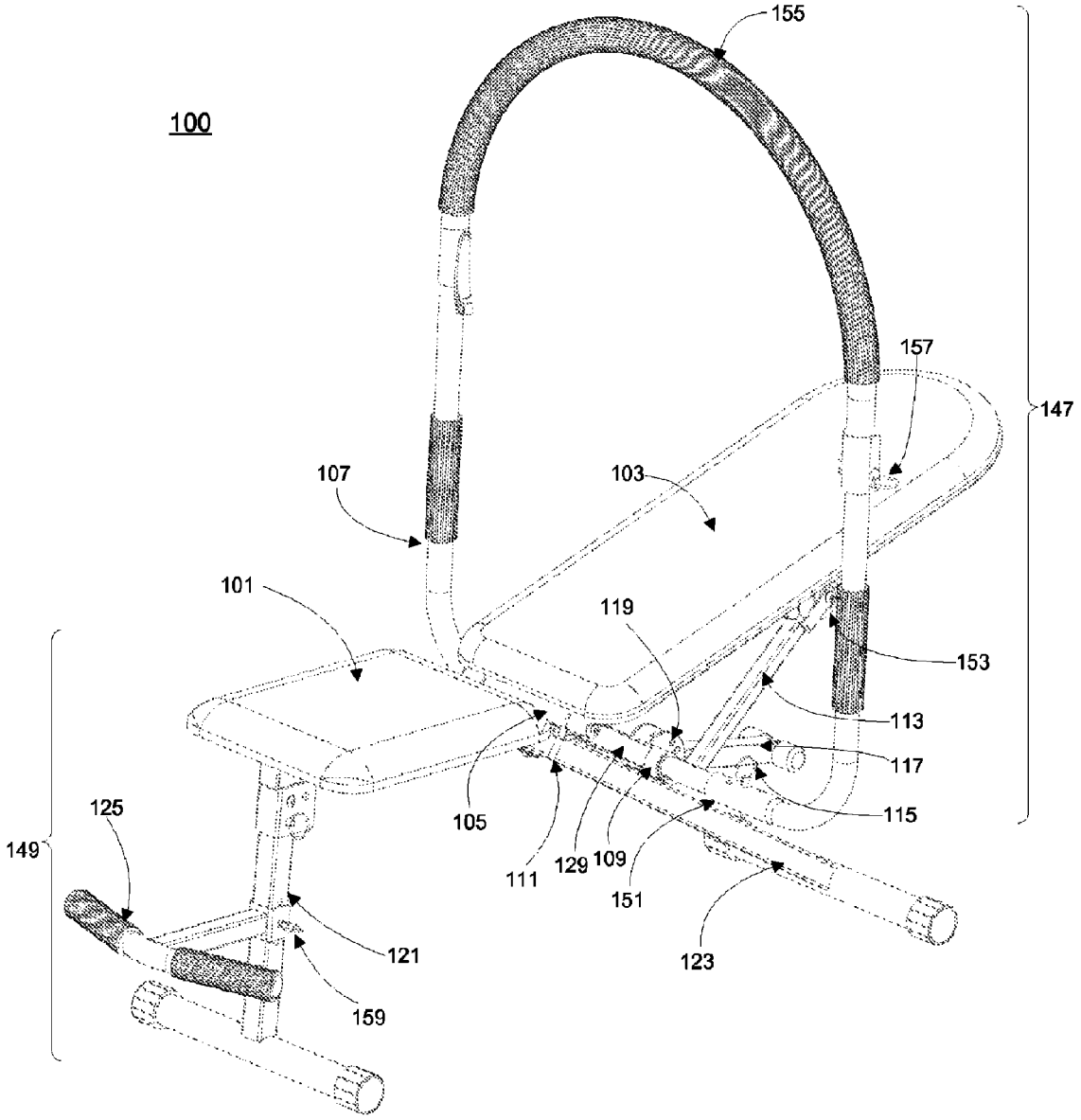
FIG. 1 is a perspective view of an embodiment of an exercise machine assembly.

FIG. 1 is a perspective view of an embodiment of an exercise machine assembly. Exercise machine (or device) 100 can include pivoting frame 147 rotatable mounted on a mounting location of base frame 149 to allow pivoting frame 147 to move rotationally and/or pivotally around the mounting location for a user to perform twisting motions along multiple rotational or bending degrees for exercising.

Base frame 149 can provide floor (or ground) support for movements of pivoting frame 147. In one embodiment, base frame 149 may be oriented longitudinally along a rear side and a front side. Seat pad 101 may be affixed to base frame 149. Seat pad 101 may be elevated to provide seating support for a user of exercise machine 100. Base frame 149 may include front leg 121 on the front side and rear leg 123 on the rear side. Foot bar 125 may be detachably and adjustably affixed to front leg 121 to provide foot support or restraint positions for a user sitting on seat pad 101. Foot bar insert 159 may be engaged with one of multiple receiving holes disposed along front leg 121 to allow height adjustment of foot bar 125.

Pivoting frame 147 may be rotatable mounted on base frame 149 via mounting assembly 129 over rear leg 123 to allow pivoting frame 147 to be longitudinally oriented (e.g. aligned) or having an angular relationship with a longitudinal direction of base frame 149. Mounting assembly 129 can include multiple pivot joints or rotatable joints capable of support multiple degrees or dimensions of movements. For example, mounting assembly 129 may include front pivot joint 105 and rear pivot joint 109 to enable pivot movements of pivoting frame 147. Front pivot joint 105 may enable both rotational movements around a transverse orientation of base frame 149 and pivoting movements along a longitudinal direction of based frame 149 substantially simultaneously. Thus, a user of device 100 can sit on seat pad 101 of base frame 149 to perform exercise movements folding or twisting the user's upper body via the pivot movements of pivoting frame 147.

In one embodiment, pivot frame 147 can include a backrest assembly pivotally coupled to mounting assembly 129 via front pivot joint 105 and rear pivot joint 109. The backrest assembly can include handling controls, such as handle bars 107, to assist a user to exert forces to cause the swivel movements of pivot frame 147. In some embodiments, handling controls may include pulling ropes or other applicable mechanisms to make the exercise movements.

In one embodiment, the backrest assembly can include backrest pad 103, handle bars 107 and lever bars 113. Backrest pad 103 can provide support to a user's upper back to make bending or twisting movements via pivot frame 147 while sitting on seat pad 101. Lever bars 113 may movably support different heights of backrest pad 103 as pivot frame 147 pivots (or rotate) around front pivot joint 105. In certain embodiments, a pivot joint may be capable of enabling movements in multiple dimensions (e.g. up and down, back and forth, horizontal rotation, vertical rotations or other applicable pivoting movements) simultaneously.

In one embodiment, pushing/resisting forces may be applied via the backside of backrest pad 103 for pivoting movements of pivoting frame 147 via lever bars 113. For example, the front ends of lever bars 113 towards the front (or forward) direction of backrest pad 103 may be pivotally coupled with mounting assembly 129 at rear pivot joint 109. Lever bars 113 may rotate pivotally around rear pivot joint 109 to push or receive backrest pad 103 via the rear ends (or upper ends) of lever bars 113.

Handle bars 107 may be affixed adjustably to the lower ends of lever bars 113 in a transverse manner at rear pivot joint 109. A user may apply force to rotate lever bars 113 back and forth to cause pivoting movements of pivoting frame 147 via hands holding handle bars 113. Angular relationships between handle bars 107 and backrest pad 103 may be adjusted via selectable positions for pin insert 115 of a locking mechanism for handle bars 107 at rear pivot joint 109. A user may make push/pull efforts through handle bars 107 to cause backrest pad 103 to pivot around front pivot joint 105. Cross handle bar 155 may be removably affixed to handle bars 107 (e.g. via lock pin 157) to provide additional handling support for the user to exert forces to induce twisting or pivoting movements.

In one embodiment, device 100 may include an adjustable control mechanism to configure (or confine) swivel movements (e.g. multi-degrees or dimensions of rotational and/or pivoting or other applicable motions) of pivoting frame 147 via mounting assembly 129 including front pivot joint 105 and rear pivot joint 109. The adjustable control mechanism can include position bar 117 for a height control and alignment pin insert 111 to provide constraints on movement paths or manners of pivot frame 147.

Position bar 117 may be adjustably attached to the rear end or rear side of mounting assembly 129 to configure an adjustable stop height or an adjustable lowest level for backrest pad 103 to pivot backwards. In one embodiment, height control 117 may be pivotally positioned around rear pivot joint 109 at the lower end of height control 117 via one of a fixed number (e.g. 4, 5, 6 or other applicable number) of apertures 119. Each aperture 119 may correspond to a different height at the higher end of position bar 117 to stop the rear end of backrest pad 103 to define, for example, a starting position for a user to make forward swivel, bending or pivoting movements.

In one embodiment, alignment pin 111 can be inserted to latch rotational positions between base frame 149 and pivoting frame 147. Thus, when alignment pin 111 is inserted, backrest pad 103 and seat pad 101 may be substantially aligned longitudinally to allow a user to focus on body pivoting movements without rotational twisting effects. Without alignment pin 111 (e.g. when removed), backrest pad 103 and seat pad 101 may not be aligned to cause twisting or swiveling forces for exercising. Backrest pad 103 and seat pad 101 may be positioned with enough space in between each other to allow rotational and/or pivoting movements of backrest pad 103.

Figure 2:
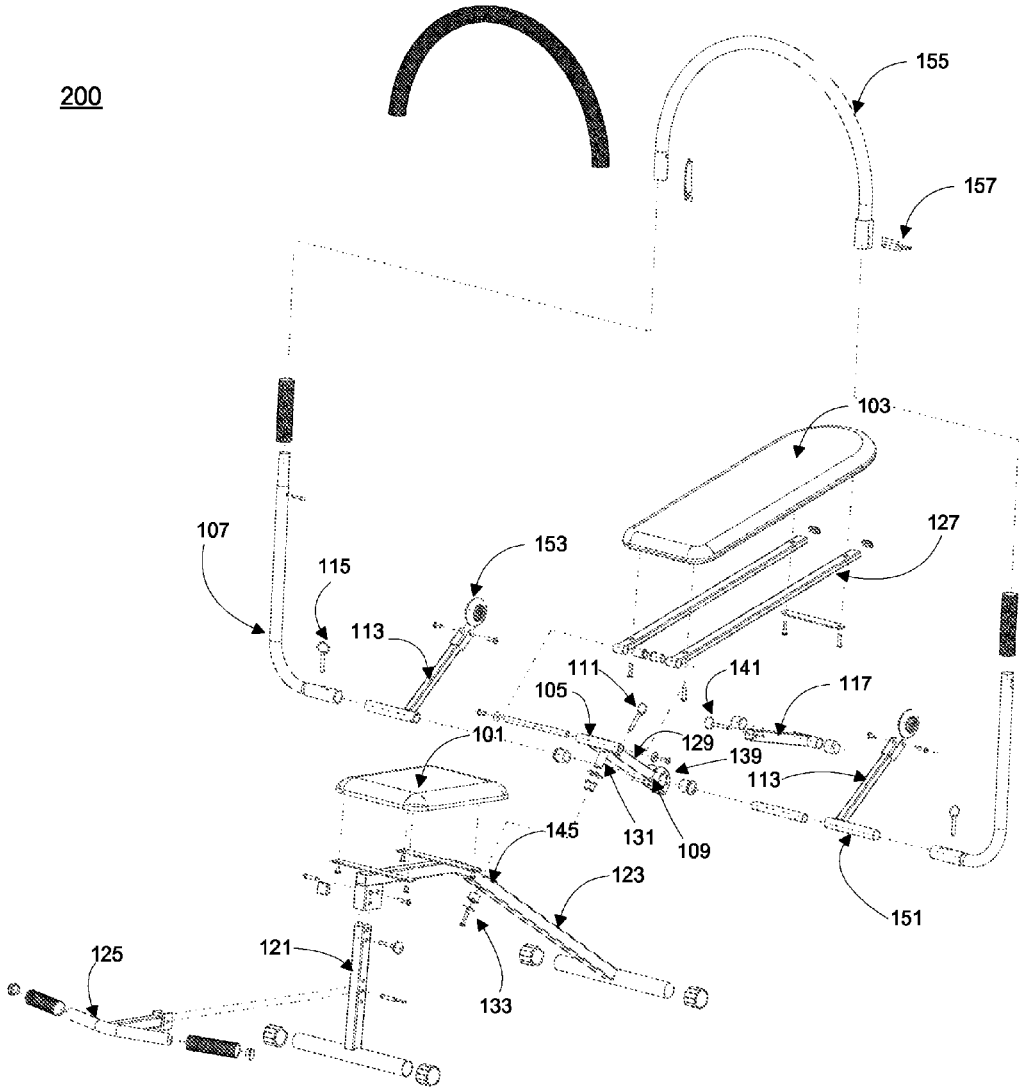
FIG. 2 is an exploded perspective view of an embodiment of an exercise machine assembly.

FIG. 2 is an exploded perspective view of an embodiment of an exercise machine assembly as shown in FIG. 1. For example, the backrest assembly can include backrest support tracks 127 longitudinally affixed to the backside of backrest pad 103. Backrest support tracks 127 may be pivotally coupled to front pivot joint 105 via the front ends of the backrest assembly (e.g. front ends of backrest support tracks 127) to enable pivoting movement of, for example, backrest pad 103.

In one embodiment, the rear ends (or upper ends) of lever bars 113 may be slidably coupled (e.g. separately on left and right sides under backrest pad 103) with the backrest support tracks 127 via rollable wheels 153 in a pivoting manner. Wheels 153 (e.g. one for each backrest support track 127 on the left and right sides of backrest pad 103) may travel along backrest support tracks 127 to support pivoting movements of backrest pad 103 around front pivot joint 105. Lever bars 113 can pivot (or rotate) around pivot joint 109 to allow the rear end of lever bars 113 to apply pushing or resisting forces for the pivoting movement of backrest pad 103.

In some embodiments, the backrest assembly can include pivot rods 151 (one or more) detachably affixed transversely to lever bars 113 at the rear ends of the lever bars 113. Pivot rods 151 may be pivotably attached to rear pivot joint 109 of the mounting assembly. Handles bars 107 may be detachably affixed to pivot rods 151 to form an adjustable angular relationship between handle bars 107 and backrest pad 103 via, for example, pin insert 115 to facility hand gripping.

Base frame 149 and mounting assembly 129 of pivoting frame 147 may be coupled via receiver structure 133 having a center opening directed upward, e.g. substantially perpendicular to the longitudinal direction of rear legs 123. Mounting assembly 129 may have a protruding rod 131 extending downwardly into the center opening of receiver structure 133 for mounting base frame 149 with pivoting frame 147. Protruding rod 131 may be arranged transversely to pivot joint 105 to allow mounting assembly 129 to rotate around receiver structure 133.

According to one embodiment, mounting assembly 129 may include position locking structure 139 arranged near real pivot joint 109. Position locking structure 139 may be configured with apertures 119 circumferentially spaced (e.g. equally) to adjustably lock in position bar 117 pivotally for a height control. The lower end of position bar 117 may be pivotally affixed to position locking structure 139 includes via height locking pin 141 selecting one of apertures 119.

In some embodiments, mounting assembly 129 can include an upper latching hole to be mated with lower latching hole 145 of base frame 149 via alignment pin insert 111. When latched, alignment pin insert 111 can confine the swivel movements of pivoting frame 147 to substantially along a longitudinal direction of base frame 149 (e.g. back and forth pivoting and left and right rotating).

Figure 3:
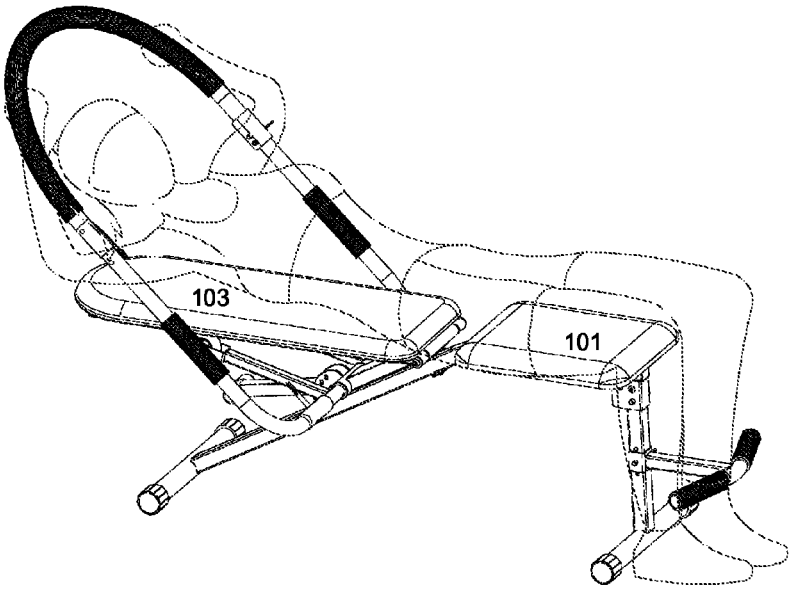
FIG. 3 shows a first example of an application of an exercise machine according to one embodiment of the present invention.
Figure 3:
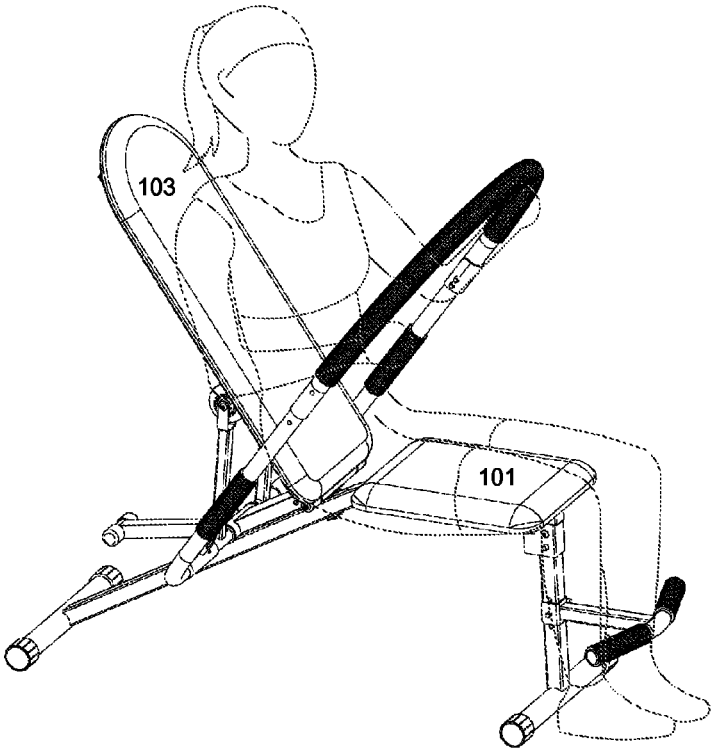

FIG. 3 shows a first example of an application of an exercise machine according to one embodiment of the present invention, such as device 1 of FIG. 1. In one embodiment, backrest pad 103 and seat pad 101 may be latched, for example, via alignment pin insert 111 of FIG. 1, to be aligned longitudinally together. Starting positions (e.g. lowest positions of the upper end) of backrest pad 103 may be configured via, for example, position control bar 117 of FIG. 1 with four different degrees of pivoting positions. A user could apply arm strength and/or waist strength to perform supine actions up and down as shown in examples 300A-300B.

Figure 4:
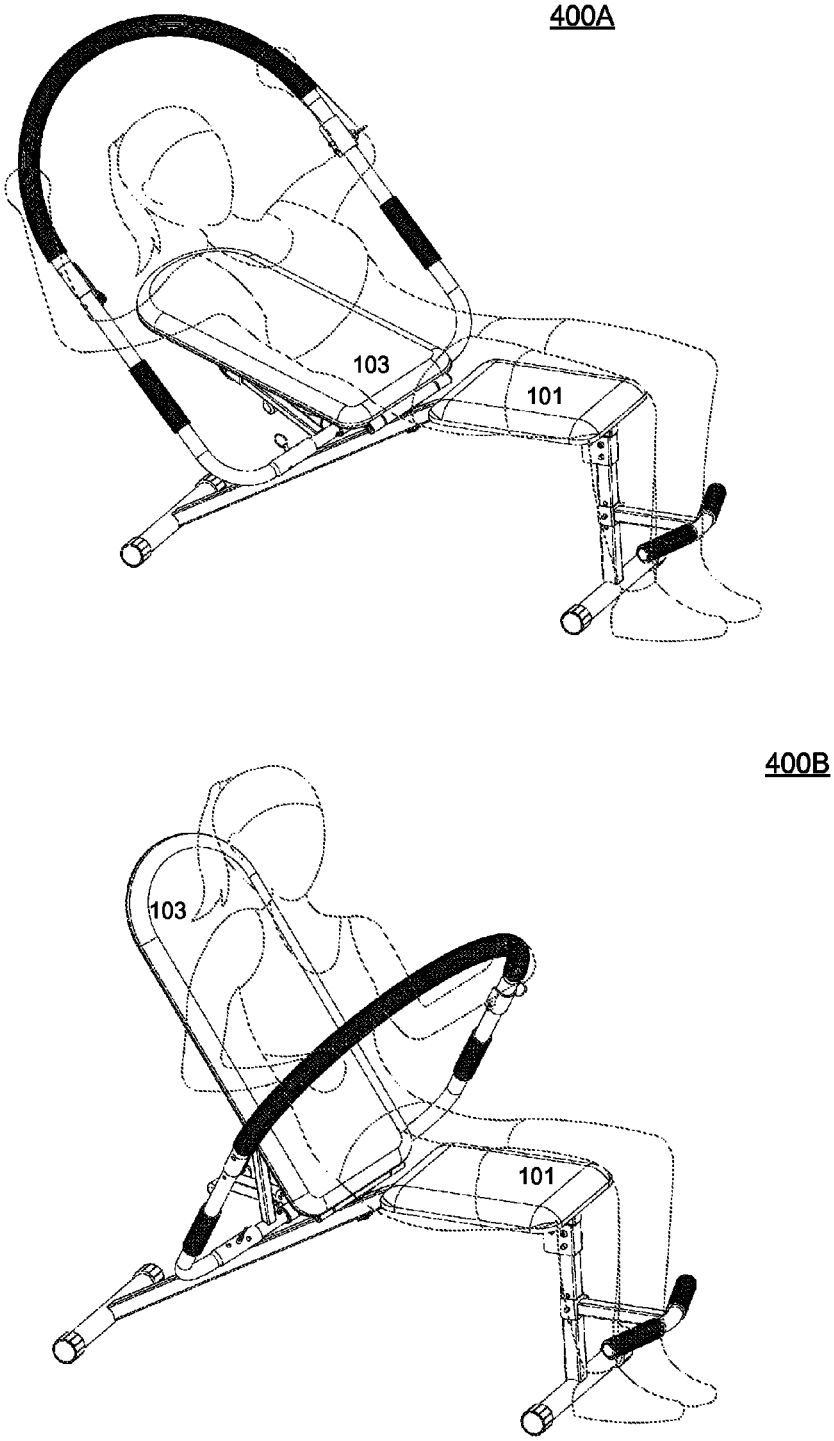
FIG. 4 shows a second example of an application of an exercise machine according to one embodiment of the present invention.

FIG. 4 shows a second example of an application of an exercise machine according to one embodiment of the present invention, such as device 100 of FIG. 1. Without being latched, for example, via alignment pin insert 111 of FIG. 1, backrest pad 103 may twist or swivel freely relative to seat pad 101. The starting height of backrest pad 103 can be adjusted via, for example, position control bar 117 of FIG. 1. A user could perform pivoting movements with right twisting as shown in examples 400A-400B.

Figure 5:
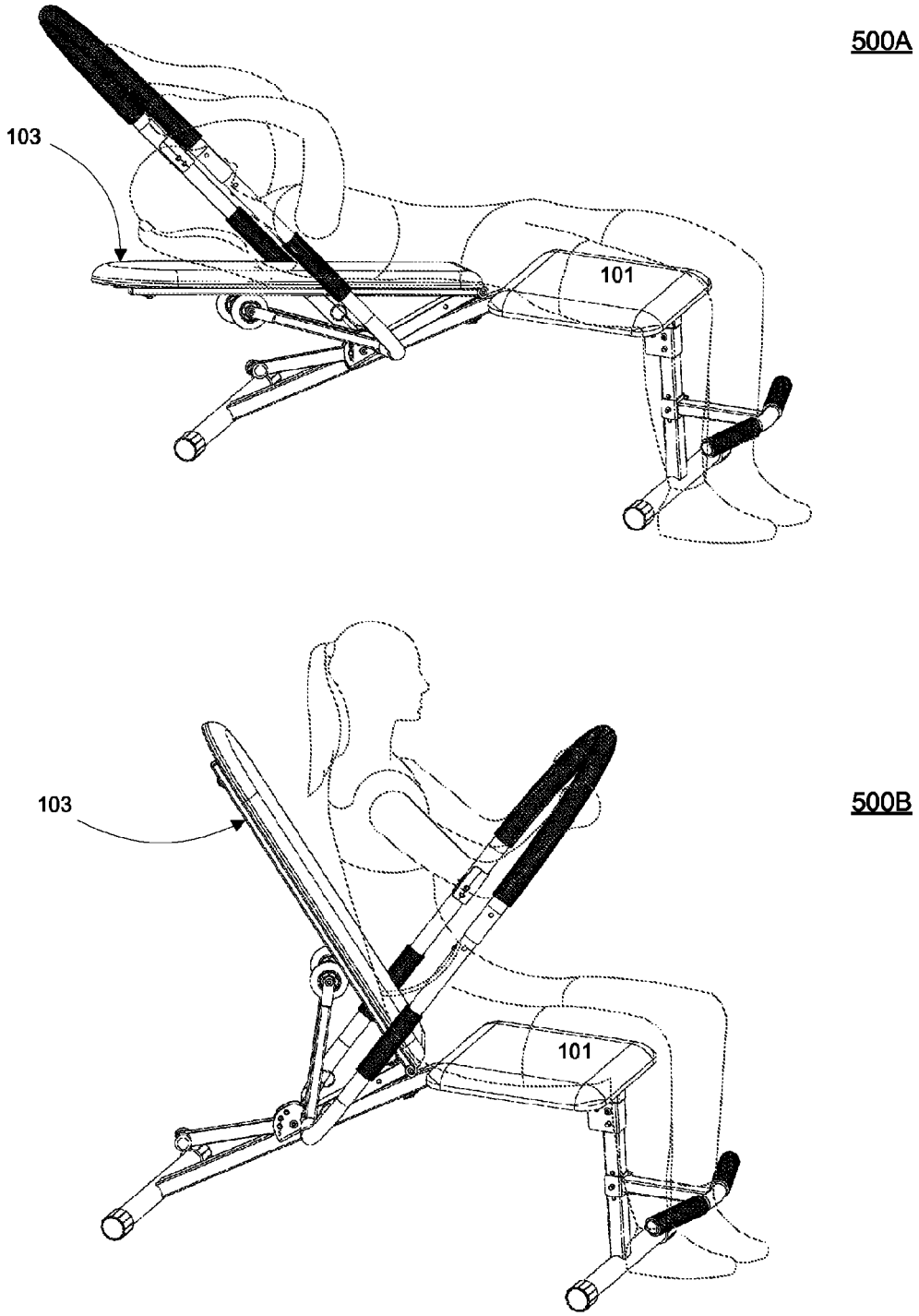
FIG. 5 shows a third example of an application of an exercise machine according to one embodiment of the present invention.

FIG. 5 shows a third example of an application of an exercise machine according to one embodiment of the present invention, such as device 100 of FIG. 1. In one embodiment, a user could perform pivoting movements with left twisting as shown in examples 500A-500B.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exercising machine comprising:

a base frame having a seat pad, a front leg and a rear leg, the seat pad elevated with the front leg and the rear leg to provide ground support;

a mounting assembly rotatably mounted on the base frame over the rear leg via a rotatable structure, the mounting assembly having at least two pivot joints including a front pivot joint and a rear pivot joint, wherein the mounting assembly has a longitudinal direction defined from the front pivot joint to the rear pivot joint, the rotatable structure arranged between the front pivot joint and the rear pivot joint along the longitudinal direction of the mounting assembly, the rotatable structure to allow the mounting assembly to rotate transversely to the front pivot joint; and a backrest assembly movably coupled to the mounting assembly via the at least two pivot joints for swivel movements along the base frame, the backrest assembly including a backrest pad and handling controls, wherein the handling controls allow a user resting against the backrest pad to control the swivel movements while sitting on the seat pad.

2. The exercising machine of claim 1, further comprising:

an adjustable control mechanism to configure the swivel movements, the adjustable control mechanism including a height control adjustably attached to the mounting assembly to provide a stop height support of the backrest pad.

3. The exercising machine of claim 2, wherein the mounting assembly includes an upper latching hole, wherein the base frame includes a lower latching hole, and wherein the adjustable control includes an alignment pin to latch rotational positions between the seat pad and the backrest pad when the alignment pin is inserted through both the upper latching hole and the lower latching hole.

4. The exercising machine of claim 3, wherein the backrest pad and the seat pad are substantially aligned longitudinally to confine the swivel movements to pivot between the front leg and the rear leg when the upper latching hole and the lower latching hole are latched via the alignment pin.

5. The exercising machine of claim 2, wherein the mounting assembly further includes a position locking structure, wherein the height control includes a position bar having a higher end and a lower end, the position bar pivotally affixed to the position locking structure via the lower end with an adjustable pivoting position, the higher end positioned at an adjustable height corresponding to the adjustable pivoting position to provide the stop height support of the backrest pad.

6. The exercising machine of claim 5, wherein the position locking structure includes apertures circumferentially spaced for the adjustable pivoting position, and wherein the height control includes a height locking pin to engage the position bar and the position locking structure via one of the apertures.

7. The exercising machine of claim 1, wherein the backrest assembly further includes lever bars and backrest support tracks affixed to the backrest pad, the lever bars coupled with the backrest support tracks via sliding wheels rollable along the backrest support tracks to support the swivel movements.

8. The exercising machine of claim 7, wherein front ends of the backrest assembly are pivotally coupled to the front pivot joint, and wherein front ends of the lever bars are pivotally coupled to the rear pivot joint.

9. The exercising machine of claim 8, wherein the backrest assembly includes a pivot rod detachably affixed to the lever bars at the rear ends of the lever bars, the pivot rod pivotably attached to the rear pivot joint of the mounting assembly, wherein the handling controls are affixed adjustably to both ends of the pivot rod to allow separate angular relationships between the handle bars and the backrest pad.

10. The exercising machine of claim 7, wherein the handling controls are adjustably affixed transversely to the lever bars to enable the swivel movements.

11. The exercising machine of claim 1, wherein the handling controls include handle bars, wherein the backrest assembly further includes a cross bar detachably coupled to the handle bars over the backrest pad to facilitate user control of the swivel movements.

12. The exercising machine of claim 1, wherein the rotatable structure includes a receiver structure having a center opening, wherein the mounting assembly has a protruding rod extending into the center opening to allow the mounting assembly to rotate around the base frame via the receiver structure.

13. An exercising machine comprising:

a base frame to provide floor support, the base frame arranged longitudinally between a front side and a rear side, the base frame including a seat pad affixed on top of the base frame; and a pivoting frame rotatably mounted on the rear side of the base frame, the pivoting frame having a backrest assembly, a mounting assembly and handle bars, the backrest assembly capable of swivel movements along the base frame, wherein the backrest assembly has a backrest pad and lever bars, the backrest pad pivotally coupled with the level bars, wherein the mounting assembly has more than one rotatable joint including a front pivot joint, a rear pivot joint and a rotatable structure, wherein the mounting assembly has a longitudinal direction defined from the front pivot joint to the rear pivot joint, the rotatable structure arranged between the front pivot joint and the rear pivot joint along the longitudinal direction of the mounting assembly, the backrest pad and the lever bars pivotally coupled with the mounting assembly via the front pivot joint and the rear pivot joint, the base frame engaged with the mounting assembly via the rotatable structure for the rotatable mounting to allow angular relationship between longitudinal directions of the seat pad and the backrest pad, wherein handle bars are transversely affixed to the lever bars to allow a user to make push/pull force to cause the swivel movements of the backrest pad, and wherein the angular relationship allows twisting effects on the user while exercising with the backrest pad via the swivel moments.

14. The exercising machine of claim 13, wherein the backrest assembly includes backrest support tracks affixed to the back rest pad, wherein the lever bars are mounted with wheels and wherein the lever bars and the backrest pad are coupled with the wheels rolling along the back rest support tracks.

* * * * *